United States Patent [19]

Weldon et al.

[11] Patent Number: 5,070,787

[45] Date of Patent: Dec. 10, 1991

[54] METHOD AND APPARATUS FOR SWITCHING AN ELECTRICAL CIRCUIT

[75] Inventors: William F. Weldon, Austin; Ben M. Rech, Round Rock; Robert L. Sledge, Austin, all of Tex.

[73] Assignee: The Board of Regents The University of Texas System, Austin, Tex.

[21] Appl. No.: 210,979

[22] Filed: Jun. 24, 1988

[51] Int. Cl.[5] ..... F23Q 5/00; H01H 39/00

[52] U.S. Cl. ..... 102/216; 200/82 R; 307/409

[58] Field of Search ..... 102/216; 200/61.08, 200/82 R; 337/409, 408

[56] References Cited

U.S. PATENT DOCUMENTS

| | | | |
|---|---|---|---|
| 2,712,575 | 7/1955 | Kiel | 337/409 |
| 2,929,892 | 3/1960 | Blomgren | 200/61.08 |
| 2,931,874 | 4/1960 | Leaman | 200/61.08 |
| 2,999,912 | 9/1961 | Kincaid et al. | 200/61.08 |
| 3,088,006 | 4/1963 | Kabik et al. | 200/82 R |
| 3,118,986 | 1/1964 | Lewis et al. | 337/409 |
| 3,264,438 | 8/1966 | Gay | 200/61.08 |
| 3,500,279 | 3/1970 | Malaspina | 337/409 |
| 3,793,501 | 2/1974 | Stonestrom | 200/61.08 |
| 3,848,099 | 11/1974 | Christian | 200/61.08 |
| 3,873,786 | 3/1975 | Lagofun | 200/61.08 |
| 3,885,223 | 5/1975 | Green | 102/216 |
| 4,311,890 | 1/1982 | Schroder | 200/61.08 |
| 4,342,978 | 8/1982 | Meister | 337/276 |
| 4,370,531 | 1/1983 | Tobin | 200/151 |
| 4,417,519 | 11/1983 | Lutz | 200/61.08 |
| 4,490,707 | 12/1984 | O'Leary | 200/61.08 |
| 4,499,446 | 2/1985 | Swanson | 337/30 |

FOREIGN PATENT DOCUMENTS

| | | | |
|---|---|---|---|
| 429812 | 2/1948 | Italy | 200/82 R |
| 4716387 | 11/1968 | Japan | 200/82 R |
| 325138 | 12/1957 | Switzerland | 102/216 |
| 113692 | 3/1918 | United Kingdom | 337/409 |
| 245581 | 1/1926 | United Kingdom | 337/409 |
| 979854 | 1/1965 | United Kingdom | 200/61.08 |

OTHER PUBLICATIONS

Instrument Technology, "Fast Relief in High Voltage Crisis", 12/77, pp. 27–28.

*Primary Examiner*—Deborah L. Kyle
*Assistant Examiner*—Stephen Johnson
*Attorney, Agent, or Firm*—Arnold, White & Durkee

[57] ABSTRACT

The invention provides an explosively actuated switch and a method of using the same. The switch will include primary conductive elements which will remain generally stationary, and one or more movable conductive elements which will be clamped between the stationary elements. Various types of mechanisms may be utilized to exert a clamping force on one or more of the stationary members. An explosive material is provided to move the movable members from engagement with the stationary members upon detonation.

1 Claim, 6 Drawing Sheets

120
116
102
114
118
114
124
110
110
120
109
100
100
109
128
138
132
126
106
130
134
145
109
128
116
108
100

METHOD AND APPARATUS FOR SWITCHING AN ELECTRICAL CIRCUIT

BACKGROUND OF THE INVENTION

The present invention relates generally to electrical switches suitable for use in high power environments, and more specifically relates to explosively-actuated switches suitable for use in such environments.

Many types of explosively actuated switches have been proposed for various applications. Explosively actuated switches typically perform their switching functions very quickly. Such switches are thus utilized in applications where actuation must be accomplished as rapidly as possible. A particular application of explosive switches is where extremely high currents must be carried by the switch and must yet be switched quickly. For example, explosive switches may be utilized with large inductive energy storage, such as may be utilized to power electromagnetic railguns. In such applications, the switch will be closed to provide high current charging of an inductor over an extended period of time, and then will be opened to commute the current to the load, preferably within a few 10's of microseconds. In such applications, the switches must be capable of carrying, for example, 750 kiloamps (kA) to 1.5 megamps (MA), yet must be capable of opening within a few 10's of microseconds. High power explosive switches also have utility in other applications, such as, for example, actuating laser flashlamps and as circuit interrupts in the electric utility industry.

Exemplary prior art explosive switches suitable for carrying high current loads have utilized solid conductive plates. These prior art switches have utilized explosive charges to sever the conductive plate along defined portions to create gaps and to open the electrical circuit. Such switches, although relatively simple in theory and structure, present several significant disadvantages. These prior art switches require a relatively large amount of explosive to overcome the shear strength of the conductor to create the gap. This relatively large amount of explosive creates a substantially greater explosive force than would be desirable, presenting a greater potential safety hazard. Additionally, because of the force which must be applied to shear the conductive plate, and the volume of material which must be moved, these switches are not as fast as would be desirable, in view of the amount of explosive utilized. Additionally, the switch must be, in essence, replaced after every shot, since the entire conductive plate may only be utilized once. This places a relatively high cost on each switch actuation. Further, the voltage holdoff in these conventional switches is limited to that established by the gap opened by the explosive. However, the conductive borders of these explosively opened gaps will often include ragged edges, which may promote arcing across the gap.

Accordingly, the present invention provides a new method and apparatus for switching high current circuits through an explosively opened switch which may utilize an optimally minimal amount of explosive to open a specific gap, which amount may be adjusted in response to the specific application in question. Further, the switch may, in large part, be reutilized. Additionally, in one preferred embodiment, the switch provides an insulative piston to block the "line of sight" across the opened switch gap to maximize voltage standoff across the gap.

SUMMARY OF THE INVENTION

The present invention provides an explosively actuated switch which has particular utility in high power applications. As used herein, a "high power application" may be considered to be one in which a switch must have a current carrying capacity of at least 250 kA. The present invention provides a switch in which first and second conductive members are adapted to be operatively coupled in an electrical circuit, and wherein the switch includes a movable member which is retained between the conductive members, at least primarily, by frictional forces. An explosive mechanism is provided to selectively cause movement of the member upon detonation of the explosive material, resulting in actuation of the switch. The explosive mechanism can be of any suitable type, but preferably is a detonating cord, such as that sold as "Primacord", placed on one side of the movable member.

In one particularly preferred embodiment, the switch includes a plurality of generally stationary conductive members and one or more movable conductive members. In this embodiment, the stationary elements will preferably define gaps which are "bridged" by the movable members. In this particularly preferred embodiment, at least a portion of the stationary members will have areas which are movable, such as by means of a wedge mechanism, toward other stationary pieces, so that the movable members can be selectively clamped between the stationary elements. A length of detonating cord is placed in these gaps such that, upon detonation, the explosive forces will act upon the movable members, either directly or indirectly, and move them from engagement, and therefore electrical communication, with the stationary conductive members.

Also in one particularly preferred embodiment, the switch will include a nonconductive piston arranged in the gap which, in a first position, will lie in the gap beneath the movable member. The piston is movable, preferably in response to the detonation force, such that when the detonating cord is detonated and the movable member is removed, the piston will be moved in the gap, to a second position, wherein the piston fills that portion of the gap between the two stationary conductive members formerly occupied by the movable member, and thereby blocks the "line of sight" between the two conductors. The piston, therefore, enhances the voltage standoff capacity across each gap of the switch. Switches in accordance with the present invention can include any desired number of movable members and gaps.

DETAILED DESCRIPTION OF PREFERRED EMBODIMENTS

Figure 1:
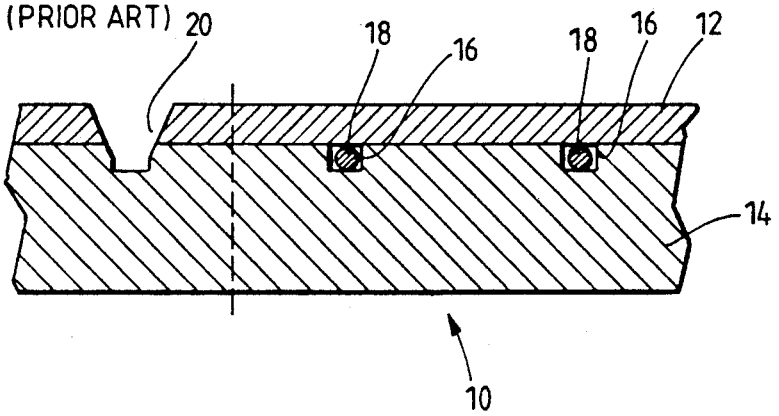
FIG.1 (PRIOR ART)
FIG. 1 depicts an exemplary embodiment of a prior art explosively-actuated switch, in contrast to the present invention.

Referring first to FIG. 1, therein is depicted an exemplary embodiment of a prior art-type switch 10, depicted in vertical section. Switch 10 includes a conductive aluminum plate 12 resting above a dielectric base 14. In an exemplary embodiment, suitable for conducting a 750 kA current, conductive member 12 would be, for example, approximately 0.25" thick, 24" in width and 18" in length. Dielectric base 14 includes a plurality of grooves 16 which lie directly adjacent to the conductive plate 12. Each groove houses a length of detonating cord 18. Detonating cord 18 is a PETN-type explosive cord, typically having at least 100 grains per foot. Actuation of the switch is accomplished by detonating detonating cord 18 which then overcomes the shear strength of aluminum plate 12, severing the plate and opening gaps 20 above the detonating cord.

Referring now to FIGS. 2A–F and 3, therein is depicted an exemplary embodiment of a switch 40 in accordance with the present invention. In the depicted embodiment of switch 40, the switch is adapted to conduct current loads of at least 1.5 MA. Such a switch may, of course, be adapted for other high current applications, from 250 kA to virtually any desired capacity.

Switch 40 includes both conductive and insulative members. Unless otherwise indicated herein, the conductive portions will preferably be copper busbars. Switch 40, depicted in FIG. 2 in vertical section, is preferably 24 inches in width ("depth" as depicted in FIG. 2), and, except as will be apparent from the following discussion, is of generally uniform cross-section. Switch 40 includes an input conductor 42 and a common conductor 44. Conductors 42 and 44 are shorted together by switch 40 when the switch is in an unactuated state, as depicted in FIG. 2. In this depicted embodiment, switch 40 is configured for use in a high current inductive storage circuit such as that which may be utilized to power an electromagnetic railgun. Accordingly, switch 40 includes an output conductor 46 through which current may be applied to the railgun load. In this unactuated state, the current path through switch 40 will be as depicted in FIG. 2E at 155.

Input conductor 42 is clamped with a conductive input plate 48 and a conductive end block 50. These members are clamped together through a plurality of coupling bolts 52 adapted so that intermediate clamping nuts 54 and 56 can affect the desired force on the members. Preferably, five coupling bolts 52 are distributed generally symmetrically across the width (of 24") of the input end of switch 40. Similarly, switch 40 includes five coupling bolts 76 distributed similarly across the second end of switch 40. In this embodiment, to accommodate output conductor 46, a commutator block 58 provides further electrical communication between end block 50 and output conductor 46. Commutator block 58 is preferably of uniform cross-section, with the exception of having milled recesses 59 to accommodate clamping nuts 54.

A dielectric plate 60, such as may be formed of unfilled high density polyethylene, is placed across the top of switch 40, and is secured in place by mounting nuts 62 on coupling bolts 52. Additionally, common conductor 44 is secured in place, along with insulating plate 84, insulating spacer plate 85 and insulating lower plate 86 by nuts 63 on clamping bolts 52. Insulating plate 85 will contain apertures, and insulating plate 85 will contain recesses, to accommodate clamping nuts 56. Each of these insulative plates will preferably be formed of unfilled high density polyethylene, and will be approximately 0.75" thick. Insulating sleeve 87 will be placed around clamping bolts 52 to electrically isolate it from common conductor 44. Insulating sleeves may be formed of PVC tubing or of other suitable dielectric materials.

Switch 40 includes a plurality of switching mechanisms, indicated generally at 64, formed of a plurality of stationary and removably clamped conductors. Switching mechanisms 64 will be discussed in more detail later herein. At the opposite, "downstream", end of switching mechanisms 64, switch 40 again includes a conductive end block 66 and conductive plate 68 in electrical connection with a conductive block 70 and output conductor 44. Conductive members 66, 68, 70 and 44 are clamped together by clamping nuts 74 and end nuts 78 on coupling bolts 76. Upper end nuts 80 clamp dielectric plate 60 at the second end of switch 40. Insulating sleeves 82 are placed around coupling bolts 76 to prevent electrical communication between output conductor 46 and coupling bolts 76. In this depicted preferred embodiment, input conductor 42 and common conductor 44 are each approximately 0.75" thick; coupling bolts 52 and 76 are each approximately 1" in diameter; and output conductor 46 is preferably approximately ¼" thick.

Switching mechanisms 64 establish a selectively conductive path between end blocks 50 and 66. Situated between end blocks 50 and 66, are a plurality of fixed conductive channels 100. Each conductive channel 100 preferably has a generally squared U-shaped cross section, and is formed of aircraft grade aluminum channel of 6061 alloy. Each channel is secured in place by a plurality of bolts 102 and nuts 104 which secure the channel to a mounting block 106. Mounting block 106 is formed of a dielectric material, with sufficient rigidity to serve as a rigid mounting surface for channels 100. Mounting block 106 is preferably formed of high pressure fiberglass-reinforced epoxy. Each channel 100 is separated from an adjacent channel by a gap 108. At the upper extent of each gap 108, each sidewall of adjacent channels 100 provides a clamping surface 109, between which a clamped bar 110, also formed of 6061 aluminum, is retained in place by outward deflection of sidewalls 112. In this preferred embodiment, each channel preferably has a nominal 2" dimension in both height and width, and a nominal 0.25" cross-section. Each clamped member 110 is preferably approximately 0.375" wide and approximately 0.25" high. This outward deflection of each channel sidewall 112 is provided by a wedge assembly 111 extending longitudinally in each channel 100.

Each wedge assembly includes a pair of opposing receiving blocks 114 adapted to receive a wedge block 116. Each receiving block 114 includes inclined surfaces 118 which are inclined from vertical 7 degrees or less, to assure proper wedging function of wedge assembly 111. Each wedge block 116 is drawn between receiving blocks 114 by bolts 120 extending through wedge block 116 and mounting block 106 to nuts 122. Receiving blocks 114 will have recesses 124 provided therein to accommodate mounting bolts 102. Wedge blocks 116 may be formed in two pieces for ease of maintaining their linearity. Both receiving blocks 114 and wedge blocks 116 are preferably constructed of steel. Wedge bolts 120 will be distributed at spaced distances across the width of switch 40. On a switch having a width of 24", eight wedge bolts 120, symmetrically distributed across the width of switch 40, have been found to perform satisfactorily. It has been found desirable to place a pair of dowel pins 126 in each conductive channel 100, to secure its relation with mounting block 106 to facilitate ease of assembly.

Looking at each gap 108, it can be seen that the sidewalls 112 which define that gap are configured to provide a tapered gap. In the depicted embodiment, gap 108 is approximately 0.60" toward the bottom, and tapered surface 128 extends to establish a nominal dimension of approximately 0.38" proximate generally parallel clamping surfaces 109 and clamped bars 110. Preferably, the thickness of each channel sidewall 112 adjacent a gap 108 will be reduced by approximately 0.12" to provide this increased gap width proximate the lower approximately 85% of the gap height.

Located in each gap is an insulating barrier 130, and a piston 132. Each barrier 130 is again formed of unfilled high density polyethylene. In the depicted embodiment each barrier is preferably approximately 0.25" in width, and has an enlarged head of approximately 0.375". Each piston 132 is adapted to fit around enlarged head 134 of barrier 130, and preferably also includes fingers 136 which extend inwardly to essentially enclose the space beneath enlarged head 134. Each piston 130 is sized to be slidable within gap 116, and includes a nose portion 138 of reduced width adapted to fit into the reduced width of gap 108 proximate clamped bar 110. Insulating barrier 130 and piston 132 will be cooperatively conformed to provide a channel 140 to accommodate a length of detonating cord 142.

As can be seen in FIG. 2, end channels 100*a* and 100*e* each have one side which contacts the respective end block 50 and 66, respectively. Similarly, input plate 48 contacts bottom surface 144 of channel 100 and output plate 68 contacts bottom surface 146 of channel 100. However, beneath each intermediate channel 100*b–d* is a dielectric layer 145 formed of high density polyethylene. These non-conducting intermediate layers between channels 100*b–d* and mounting block 106 assure that all current flow is through channels 100. Dielectric layer 145 is depicted as being integrally formed with barriers 130. However, dielectric layer 145 may also be formed of separate segments, and barriers 130 may similarly be separate members.

Situated above switch mechanism 64 is a block 148 of dielectric foam which is preferably an expanded polyethylene foam. Foam block 148 is approximately 2" thick and extends across the entire dimension of assembled switch mechanisms 64, from one side of channel 100*a* to the opposing side of channel 100*e*. Another dielectric layer 150, also preferably formed of high density polyethylene, is preferably formed between block 148 and commutator conductor 46 by layer 152. An additional layer 154 may also be placed as additional insulation proximate coupling bolts 76. Additional dielectric layers 143, 145 may be added as necessary to assure electrical isolation of clamping bolts 76. Foam block 148 is adapted to receive clamped bars 110 as they are explosively driven from their initial position between channels 100. To facilitate this retention function, it is preferable to form shallow V-shaped grooves 156 in block 148 which will extend directly above each clamped bar 110 when foam block 148 is in its assembled configuration. Grooves 156 enhance the ability of each clamped bar 110 to pass into and be retained by foam block 148.

In the described embodiment, rated at 1.5 MA, wedge bolts 120 are torqued to provide 10,000 psi clamping force on clamped bars 110. This minimizes voltage drop across the channel 110/clamped bar 112 interface. Detonating cord 142 is preferably 15 grains per foot PETN explosive, less than one-sixth that which is typically required through use of a monolithic-type switch as depicted in FIG. 1. Each length of detonating cord 142 is coupled back to a common detonator. This detonator can be of any suitable type. An exploding bridge wire (EBW) detonator has been found to perform satisfactorily.

Figure 2B:
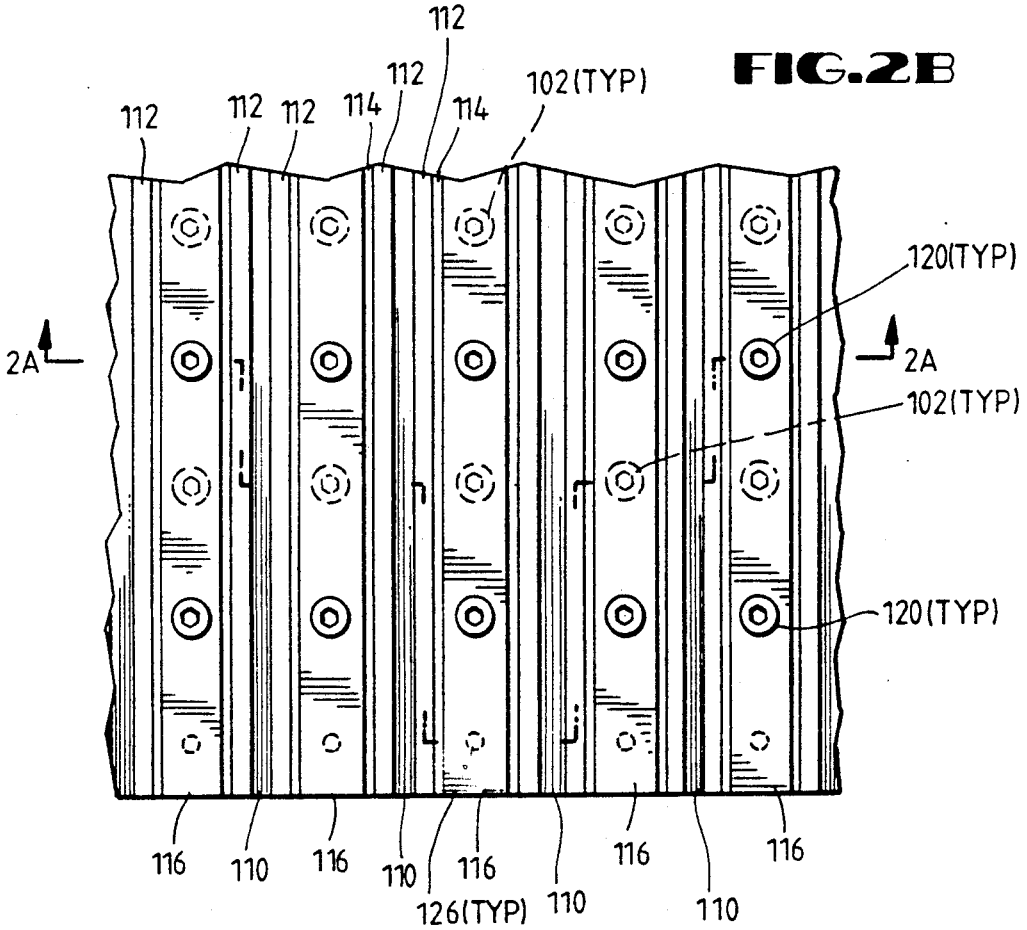
FIGS. 2 A–F depict an explosively-actuated switch in accordance with the present invention, illustrated in FIG. 2A in vertical section at varying depths, along the section line in FIG. 2B, and in FIG. 2B from a top plan view.
FIG. 2C depicts a portion of the switch of FIG. 2A in greater detail.
FIG. 2D depicts the portion of the switch of FIG. 2C after actuation.
FIG. 2E depicts a current path through the switch of FIG. 2A prior to actuation.
FIG. 2F depicts the current path through the switch after actuation.
Figure 2C:
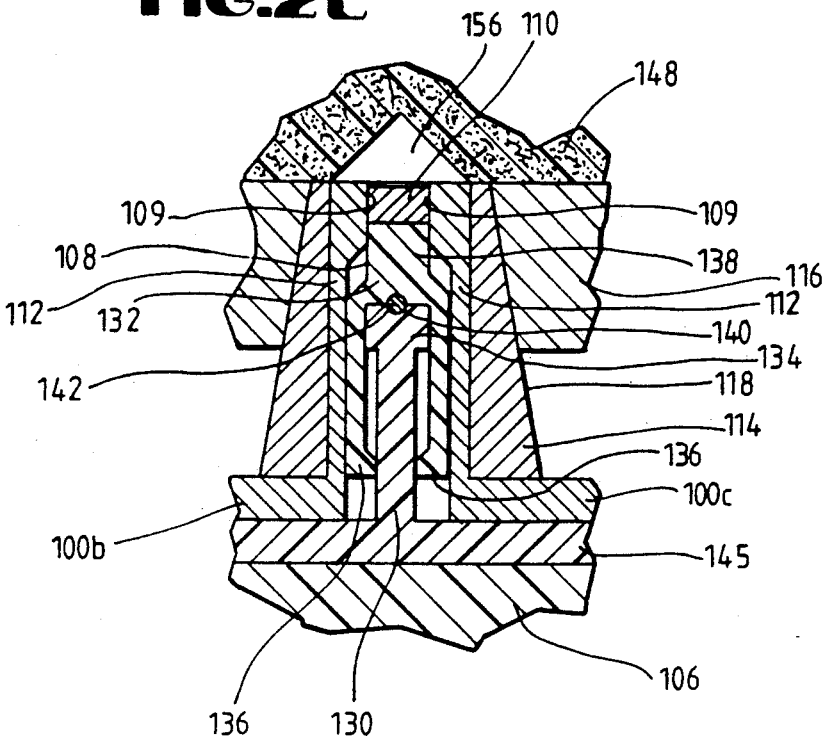
Figure 2D:
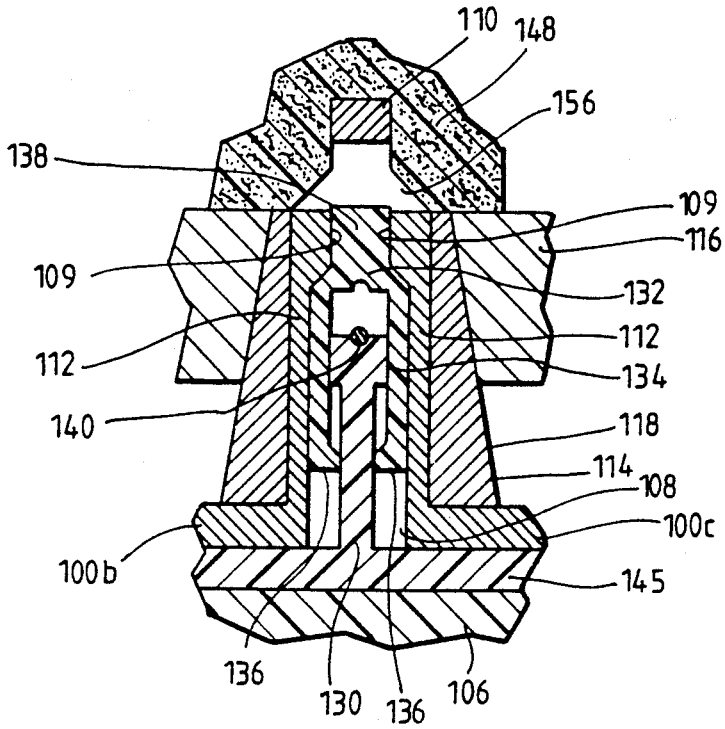
Figure 2A:
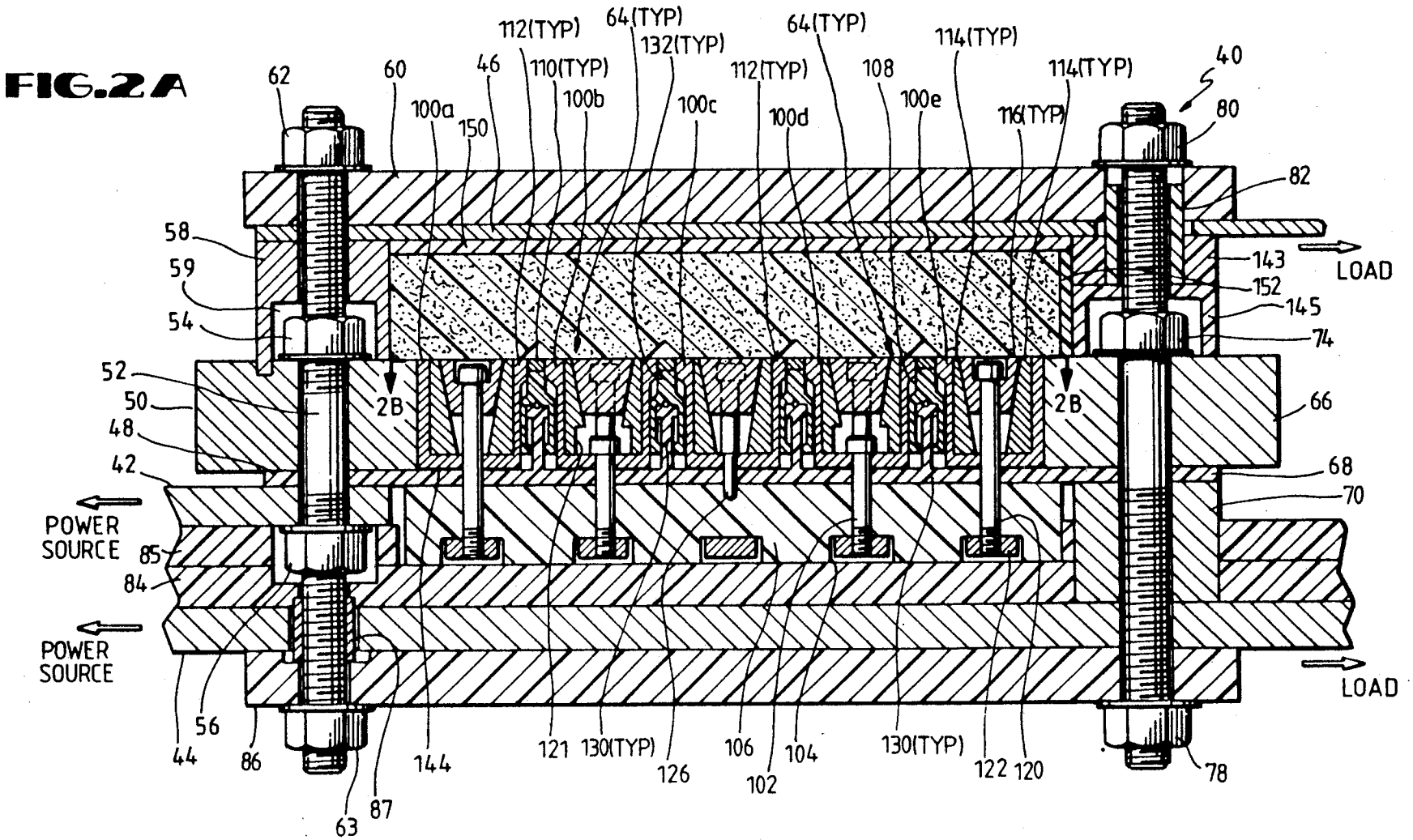
Figure 2E:
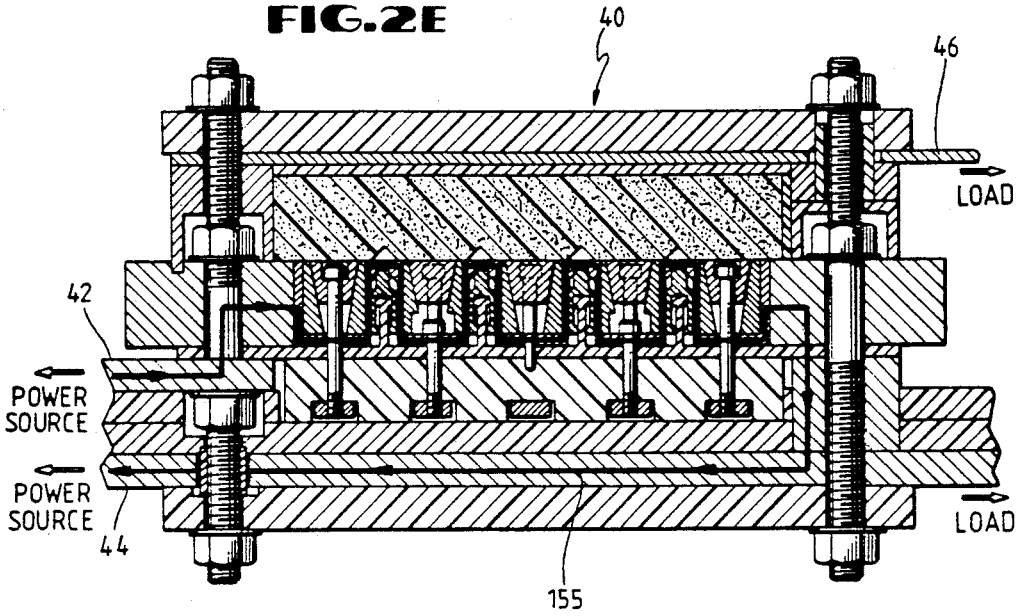
Figure 2F:
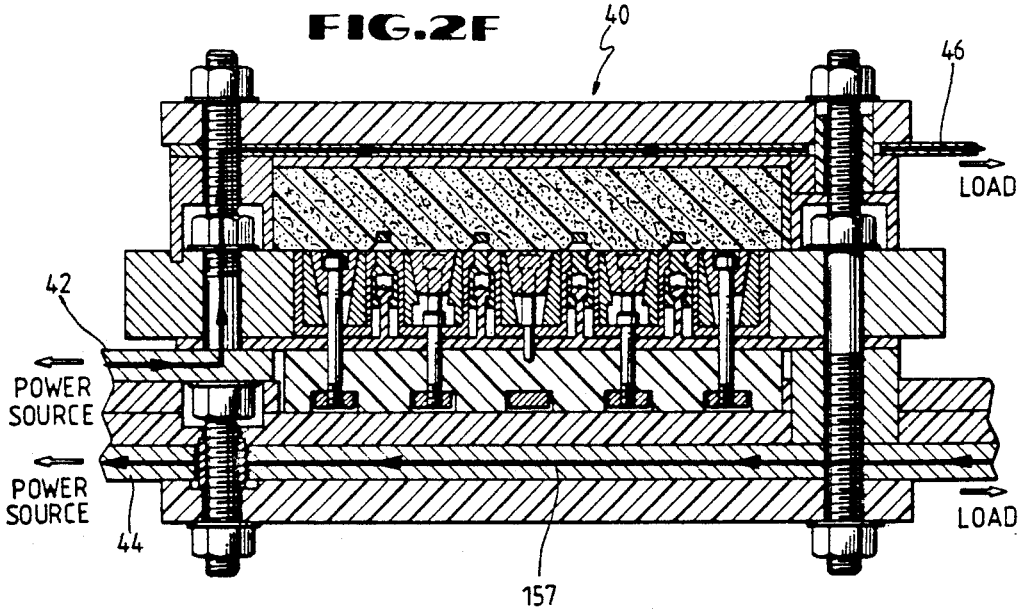
Figure 3:
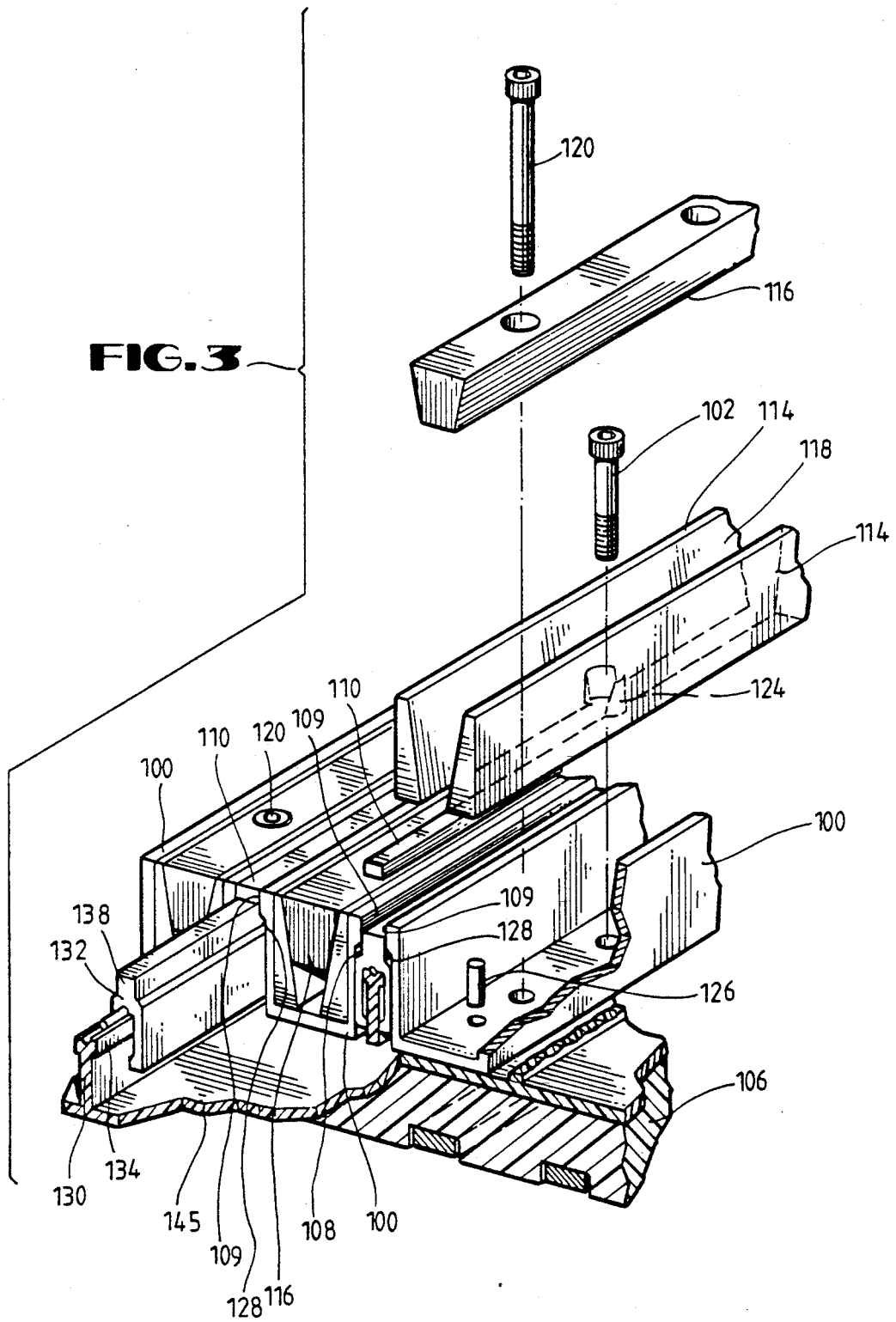
FIG. 3 depicts a portion of the switch of FIG. 2, illustrated in an oblique and exploded view.

Referring now in particular to FIG. 2D, in operation of switch 40, when the switch is desired to be actuated, the detonator will be actuated, initiating a booster charge which detonates each length of detonating cord 142. The force of each explosion will drive each piston 132 upwardly, ejecting clamped bar 110 from its position between the adjacent channels 110. The clamped bar will be propelled upwardly into foam block 148 and will be retained in foam block 148. Additionally, the nose 138 of each piston 132 will be driven into the space in gap 108 previously occupied by clamped bar 110. This position of nose 138 of piston 132 serves to block the line of sight between adjacent surfaces of channels 100. This line of sight blocking maximizes the voltage standoff which can be maintained across each gap 108. In this embodiment, voltage standoffs of 2500 volts and even higher may be maintained across each gap 108. At such time, the current path may be directed through switch 40 to a load, as depicted at 157 in FIG. 2F.

Operation of switch 40 provides several significant advantages over prior art designs. The switch provides a movable member of minimal mass to be moved by the explosive. The switch, therefore, operates quickly and requires a minimal amount of explosive to overcome the frictional forces holding the bar between the clamping surfaces. Further, those skilled in the art will recognize that the gasses resulting from the detonation of detonating cord 142 are conductive, and will therefore promote arcing across each gap 136. However, the arrangement of the conductive paths in switch 40 defines a generally U-shaped path, with the open ends of the "U" being represented by input conductor 42 and common conductor 44. Those skilled in the art will recognize that this conductive path will tend to compress the magnetic flux between the conductors. Accordingly, when switch 40 is actuated, this compressed magnetic field serves to enhance both the upward movement of clamped bars 110 and the outward expansion of the gas, thereby promoting cooling of the gas and the extinguishing of any arc. Additionally, and importantly, any arcing which occurs will occur between the uppermost corners of adjacent channels 100. Such arcing, for the short time it exists, will cause slight pitting of the surfaces. However, because clamped bars 110 are retained beneath these corners, as set forth earlier herein, the clamping surfaces 109 are not affected by the arcing. Therefore, both clamped bars 110 and channels 100 may be reused for a number of shots without diminishing either the electrical performance of the switch when assembled or the actuation performance of the switch.

Figure 4A:
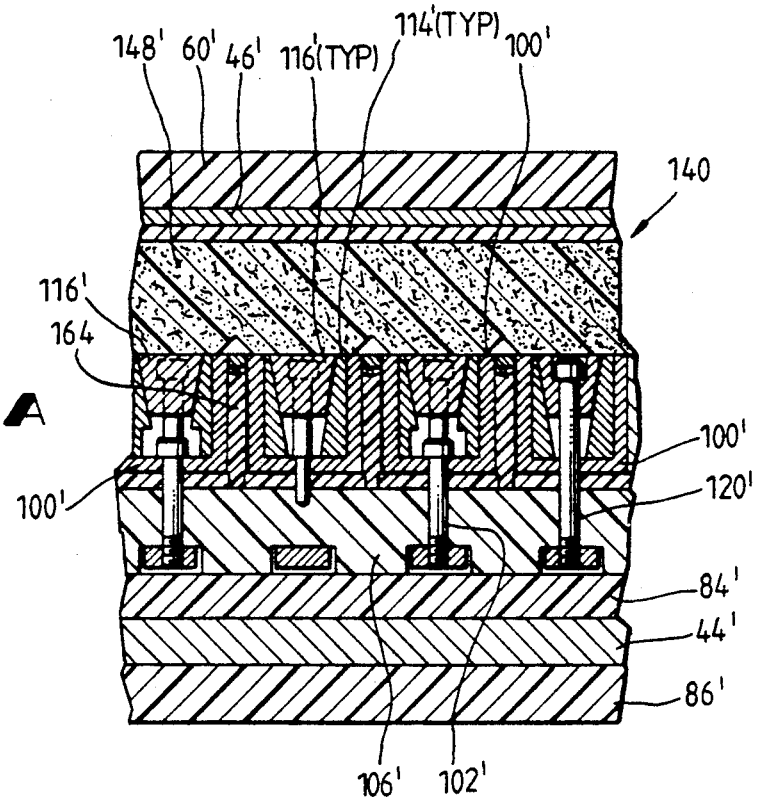
FIGS. 4 A–B depict an alternative embodiment of a switch mechanism in accordance with the present invention, depicted in pertinent vertical section at varying depths in FIG. 4A, and in greater detail in FIG. 4B.
Figure 4B:
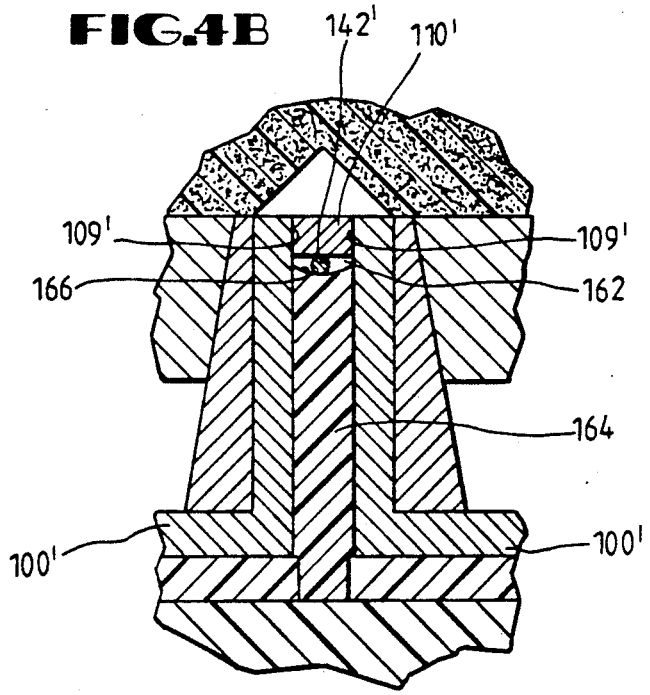

Referring now to FIGS. 4 A-B, therein is depicted an alternative embodiment 140 of a switching assembly which does not include the line of sight blocking piston. Elements which are similar (though not necessarily identical) to elements of switch 40 are numbered as "primes" of the previous numbers of those elements in switch 40. As with the preceding embodiment, adjacent channels 100' have clamping surfaces 109', between which are retained clamped bars 110'. However, substantially filling each gap 162 between channels 100' and beneath clamped bars 110' is a dielectric barrier 164 , again preferably formed of high density polyethylene. Barrier 164 includes a recess or groove 166 in its upper surface which receives detonating cord 142'. Actuation of detonating cord 142' again serves to drive clamped element 110' from between channels 100'. Any arcing which might occur across gap 162 will again occur at upper corners of channels 100' and therefore will again not damage clamping surfaces 109' of channels 100' Switches of this design, with a gap width of 0.38" have been found to provide voltage standoff of 1500 to 2500 volts per gap.

A particular advantage of switches of the present invention is that they may be formed, as depicted herein, in a relatively modular form. For example, only the number of gaps needed to provide the required voltage standoff need be utilized. Additionally, while multiple switching assemblies (defining a similar number of gaps), may be utilized with any switch, it is only necessary to use detonating cord in those assemblies which are required to yield the desired voltage standoff. Thus, even in a multiple gap switch, only one or more of the gaps, as needed, may be actuated. Additionally, the "height" of each clamped bar, and the cross-sectional wall thickness of the channels, may be adapted to provide increased current carrying capacity, or may be reduced for lower current applications. With such modifications, the volume of explosive utilized may similarly be adjusted to just that amount necessary to reliably overcome the clamping force on the clamped bar required of the particular embodiment in question.

Many modifications and variations may be made in the techniques and structures described and illustrated herein without departing from the spirit and scope of the present invention. For example, the assembly can be used with various configurations which facilitate the releasable clamping of an element between two conductive elements. For example, switches with a basically circular configuration, rather than rectangular, may be utilized. Additionally, various types of apparatus may be utilized to apply the clamping force to the clamped member. Accordingly, it should be readily understood that the embodiments described and illustrated herein are illustrative only and are not to be considered as limitations upon the scope of the present invention.

We claim:

1. An explosively actuated switch, comprising:

a first conductive surface;

a second conductive surface, said first and second conductive surfaces placed in generally opposing relation to one another;

at least one wedge member operatively coupled to said first conductive surface to selectively cause movement of said first conductive surface toward said second conductive surface;

a removable conductive member which, in a first state, is retained between said first and second conductive surfaces by a force applied, at least in part, by said wedge member, and which, in a second state, is moved from electrical contact with said first and second surfaces, wherein said first and second conductive surfaces define a gap, and wherein said gap is bridged by said removable member when said removable member is in said first state to establish a conductive path between said first and second conductive surfaces; and an explosive material proximate said removable member for selectively causing movement of said removable member upon detonation of said explosive material, wherein said explosive material comprises a length of detonating cord and wherein said length of detonating cord is located within said gap.

* * * * *